US005147002A

United States Patent [19]

Hughes

[11] Patent Number: 5,147,002

[45] Date of Patent: Sep. 15, 1992

[54] ROBOTIC DECONTAMINATION APPARATUS

[75] Inventor: Joel J. Hughes, Wilmington, N.C.

[73] Assignee: Container Products Corporation, Wilmington, N.C.

[21] Appl. No.: 633,280

[22] Filed: Dec. 24, 1990

[51] Int. Cl.[5] ..... A47L 9/00; B62D 51/04; G08B 5/36

[52] U.S. Cl. ..... 180/6.5; 15/319; 15/339; 15/340.1; 15/359; 180/9.22; 358/99; 358/100; 358/210; 358/229

[58] Field of Search ..... 180/6.5, 9.22; 15/319, 15/339, 340.1, 359; 358/229, 210, 93, 99, 100

[56] References Cited

U.S. PATENT DOCUMENTS

| | | | |
|---|---|---|---|
| 3,490,090 | 1/1970 | Harrison | 15/339 |
| 4,238,828 | 12/1980 | Hay et al. | 358/100 |
| 4,369,543 | 1/1983 | Chen et al. | 15/339 |
| 4,729,444 | 3/1988 | Tubman' | 180/9.22 |
| 4,766,432 | 8/1988 | Field | 15/339 |
| 4,996,468 | 2/1991 | Field et al. | 15/319 |

FOREIGN PATENT DOCUMENTS

| | | | |
|---|---|---|---|
| 216676 | 10/1985 | Japan | 358/99 |

*Primary Examiner*—Mitchell J. Hill

[57] ABSTRACT

A remote controlled decontamination apparatus for removing, collecting and remotely disposing of contaminated material, including a complete system that provides a self-propelled vehicle having separate drives for left and right track assemblies as well as tool handling support arms, which are easily and quickly detachable from the vehicle thus permitting the association of a wide variety of tooling such as spray and vacuum nozzles and or mechanical brushes. A hose and cable umbilical for the apparatus is provided with universally movable carriage devices to reduce hose and cable drag, roll over and maneuverable resistance. A remote controlled camera and lighting system is mounted on the vehicle for visualization of operation.

13 Claims, 6 Drawing Sheets

ROBOTIC DECONTAMINATION APPARATUS

TECHNICAL FIELD

This invention relates to a self-propelled remote controlled robotic apparatus that is capable of decontamination of radioactive, toxic and hazardous material from contaminated surfaces.

BACKGROUND OF THE INVENTION

The problem of radioactive, toxic and hazardous material contamination is of long standing. Presently their exists a lack of adequate equipment and methods for removing contaminated material which exhibit very high radiation levels that would be extremely hazardous or even lethal to working personnel. Many Department of Energy facilities and nuclear power stations have many such areas of contamination which include but are not limited to hot cells, spent fuel processing rooms, refueling cavities and radioactive waste storage areas.

Numerous remote contamination removal units have been proposed such as that shown in U.S. Pat. No. 4,149,345, dated Apr. 17, 1979 and U.S. Pat. No. 4,444,146, dated Apr. 24, 1984. These known apparatuses however are limited in application because of their restricted construction which embodies a single fixed means of material removal as well as being limited in maneuverability thus directly effecting their performance as well as the safety level required when dealing with highly radioactive and toxic material.

BRIEF DESCRIPTION OF THE INVENTION

The present invention comprises a remote controlled, self propelled vehicle that includes twin belt drives with proportionate steering. The vehicle is equipped with dual hydraulic lifting arms that provides floating tool holders, including a quick change assembly whereby spray vacuum tool heads, spray wands and/or mechanical brush tools may be readily attached to or removed from the vehicle. A cleaning material dispensing unit as well as a vacuum hose component is readily attachable to the vehicle and the selected decontamination tool mounted thereon.

A video camera with pan and tilt drive as well as a lighting system is carried by the vehicle and controlled and monitored from a control console.

Various advantages and features of novelty which characterize this invention are particularly set forth in the description of the invention.

DESCRIPTION OF THE DRAWINGS

The invention will be best understood by reference to the accompanying drawings which illustrate the preferred form of construction and arrangement of parts by which the objects of the invention are achieved, and in which.

GENERAL DESCRIPTION OF THE INVENTION

Figure 1:
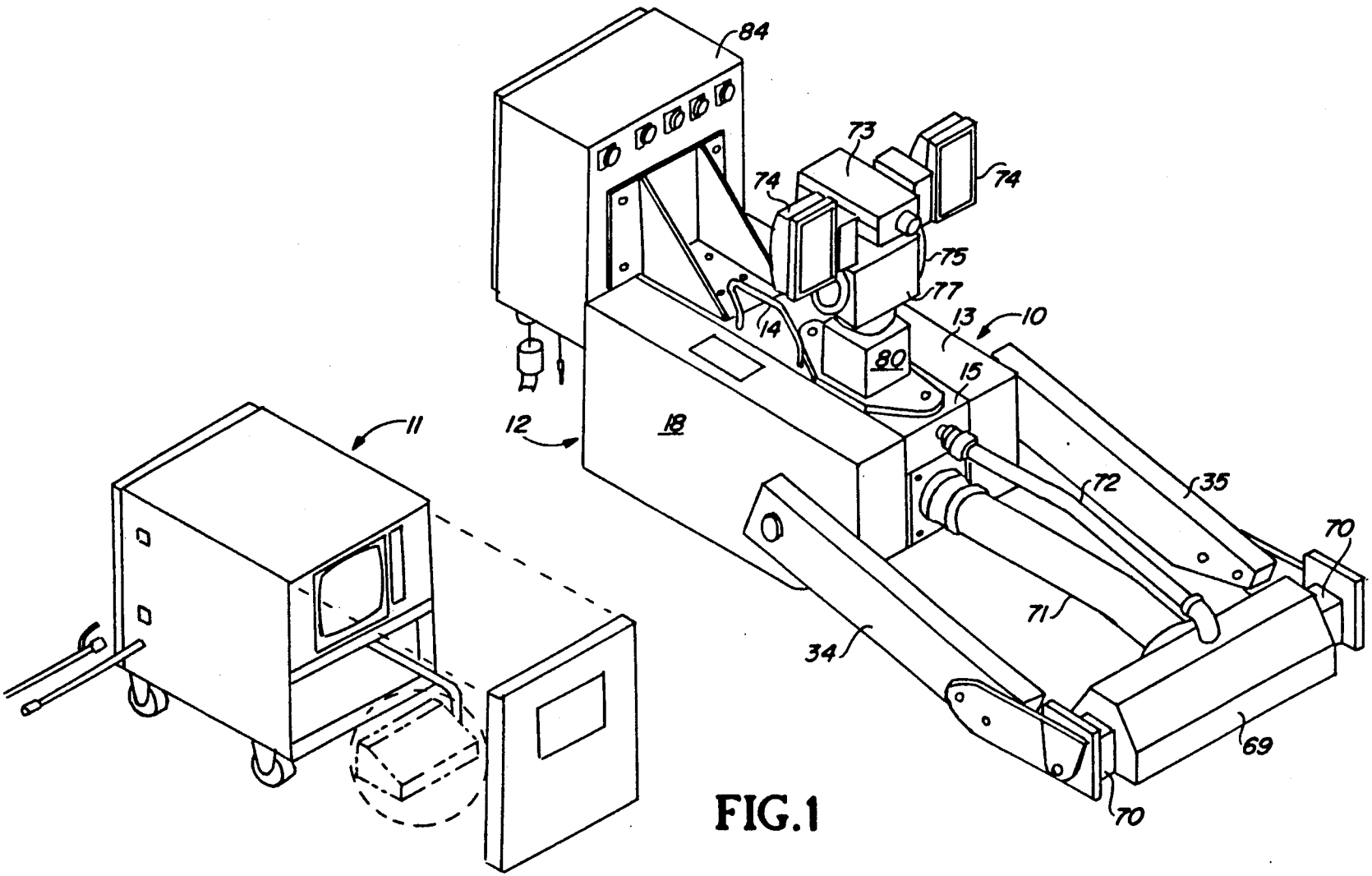
FIG. 1 is a perspective view of the remote decontamination vehicle and the control console therefore.

FIG. 1 illustrates the general design of the remote controlled self propelled vehicle 10 together with the remote vehicle and monitor control station 11.

Figure 2:
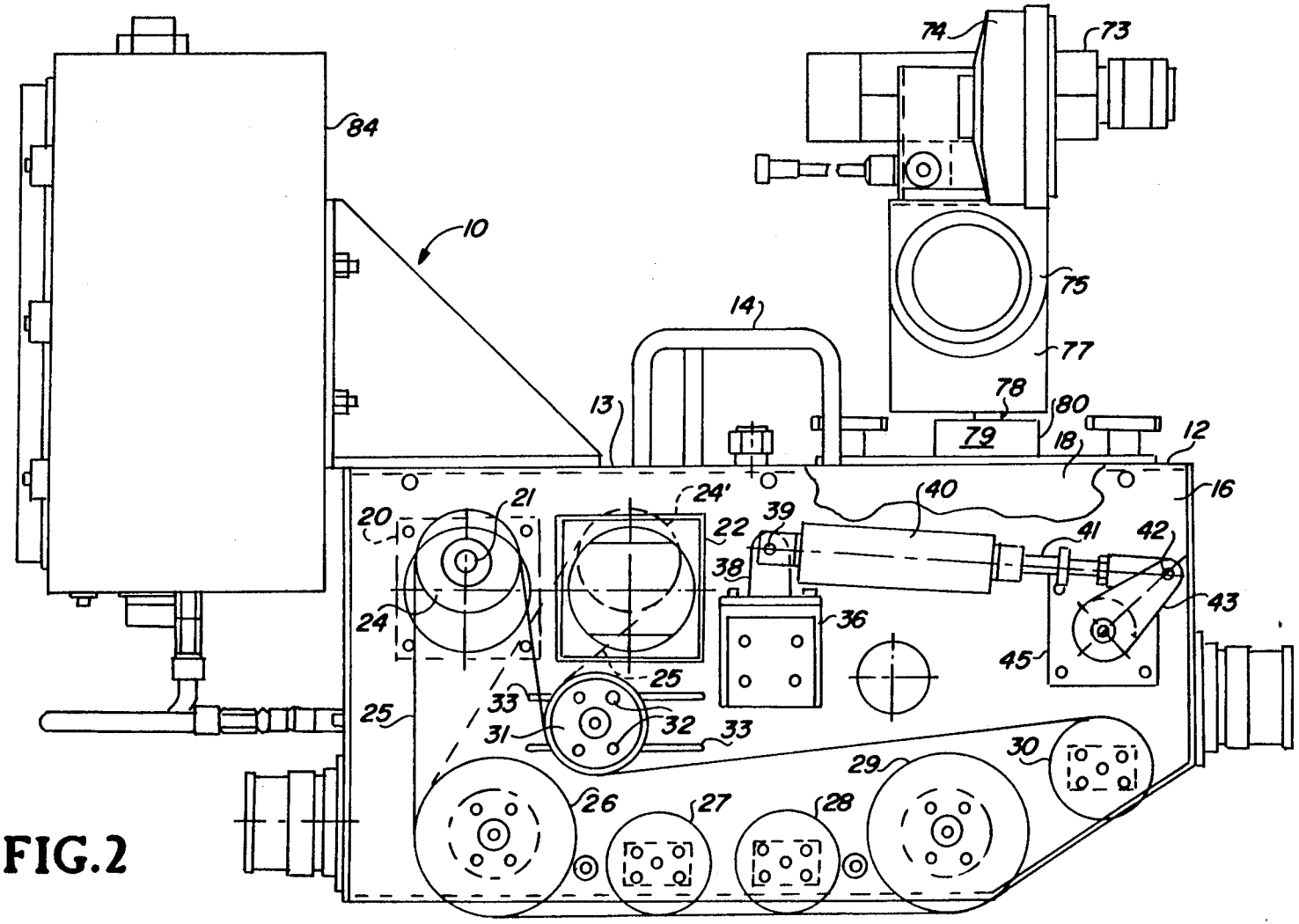
FIG. 2 is a side elevational view of the decontamination vehicle with a side wall partially removed.
Figure 3:
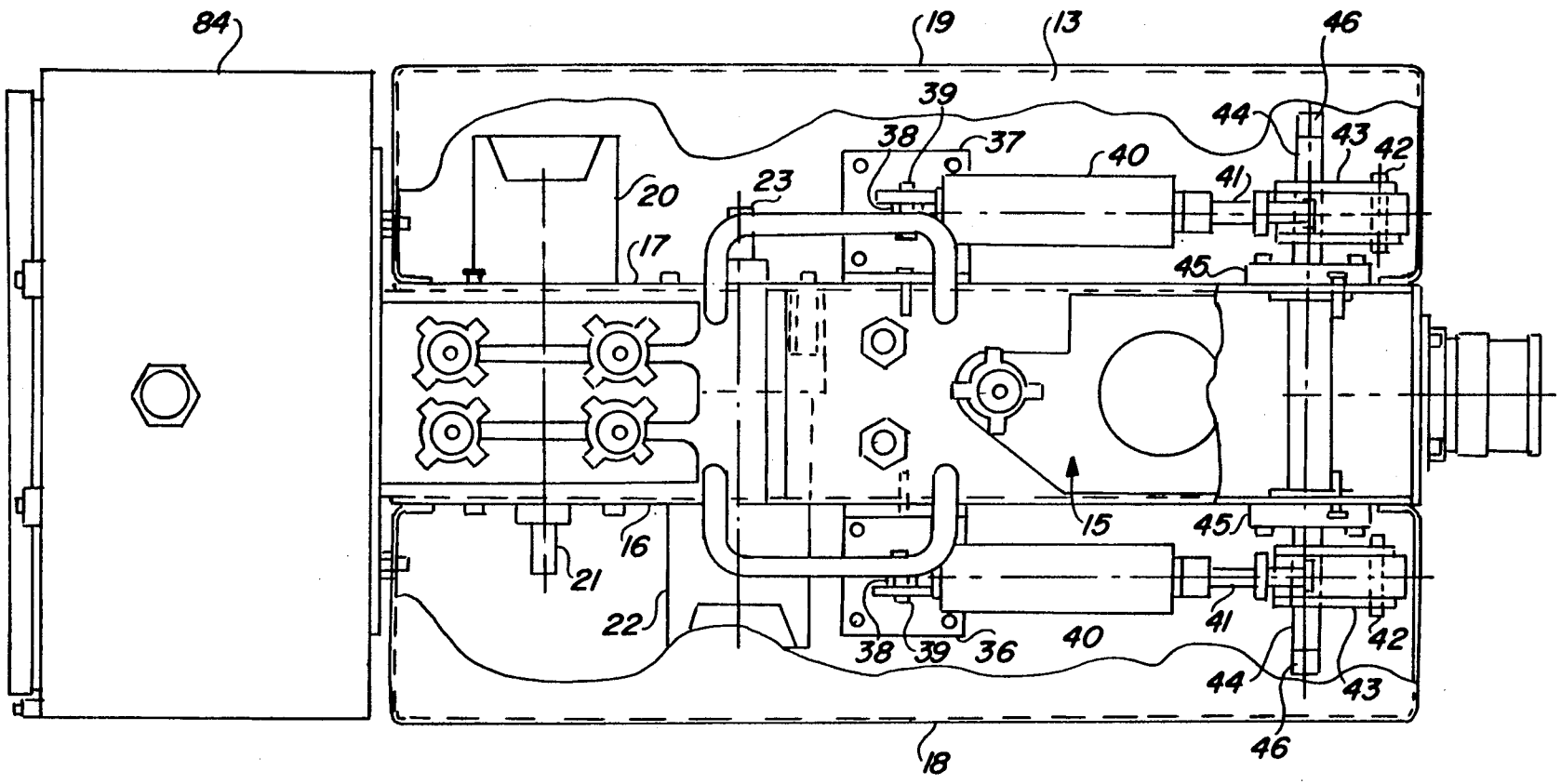
FIG. 3 is a top plan view of the vehicle with portions of the top wall removed.

As more specifically detailed in FIGS. 2 and 3 the vehicle 10 includes a body 12 having a top wall 13 which supports a pair of lifting handles 14. A center compartment 15 provides side walls 16 and 17 which extend in spaced parallel relation to the side walls 18 and 19 of the body 12.

As seen in FIG. 3 the side wall 17 of the compartment 15 supports an electric motor 20, the drive shaft 21 of which extends through the compartment 15 and exits beyond the side wall 16 thereof. A like electric motor 22 is mounted on the side wall 16 of the compartment 15 and its drive shaft 23 exits beyond the other side wall 17 as shown.

Mounted on each shafts 21 and 23 are a pair of drive pulleys 24 and 24' (see FIG. 2). Each of these drive pulleys 24 and 24' embrace a drive track 25 which in turn is threaded over a series of idler sprockets 26,27,28,29 and 30. Each of which is mounted on a bearing supported shaft carried by the appropriate side wall of the compartment 15.

Each drive track 25 engages an adjustable idler sprocket 31. The adjustability of the sprocket 31 is achieved by having its mounting connectors 32 projected into and movable through elongated slots 33 formed in the adjacent side wall of the compartment 15. By this arrangement the drive tracks 25 may be suitably tensioned to be driven by its respective motor so as to propel the vehicle over the surface to be cleaned. It should be noted that each of the motors 20 and 22 may be individually controlled so that through selected manipulation the vehicle 11 may be turned in either direction.

The vehicle 10 is provided with a pair of tool supporting arms 34 and 35. These arms 34 and 35 are adapted to be connected to the body 12 of the vehicle 10 by an arrangement which permits the arms to be raised or lowered relative to the surface to be cleaned. To accomplish this each of the side walls 16 and 17 of the compartment 15 supports an L shaped mounting bracket 36 and 37. Each bracket 36 and 37 include a free standing post 38 which by a suitable pivotable connector 39 is attached to one end of a hydraulic cylinder 40.

As shown in FIG. 2 the movable piston 41 of the cylinder 40 is connected as at 42 to the free end of a pivot link 43. The pivot link 43 is integral with a pivot shaft 44 mounted in a suitable bearing 45 mounted on its associated side wall.

As shown in FIG. 3 the free end of the shaft 44 is provided with a reduced keyway 46 which will be receptive to a receiving socket 47 (see FIG. 4) provided by one end of a supporting arm 34. By this arrangement through the actuation of the hydraulic cylinders 40 and pivotal link connections between the pistons 41 and the cooperating ends of arms 34 and 35 the same may be raised and lowered as the links 43 are pivoted.

Figure 4:
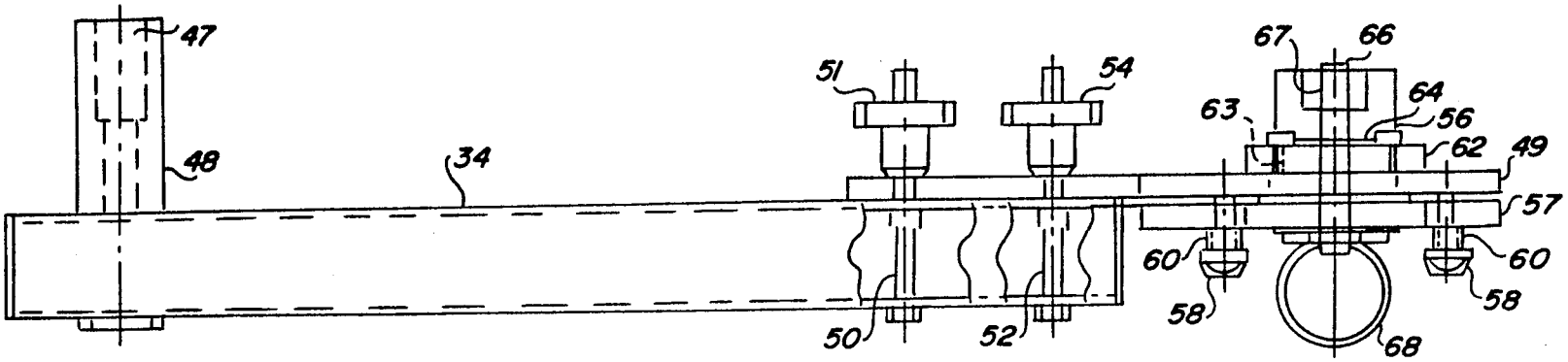
FIG. 4 is a top plan view of one of the lifting arms associated with the vehicle.
Figure 5:
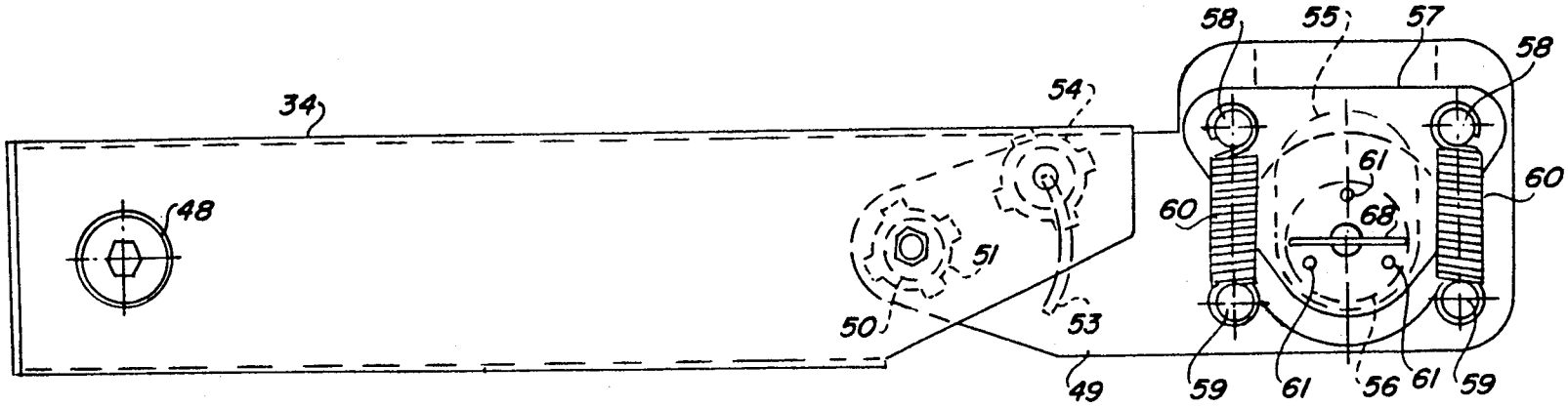
FIG. 5 is a side elevational view of one lifting arm of the vehicle.
Figure 6:
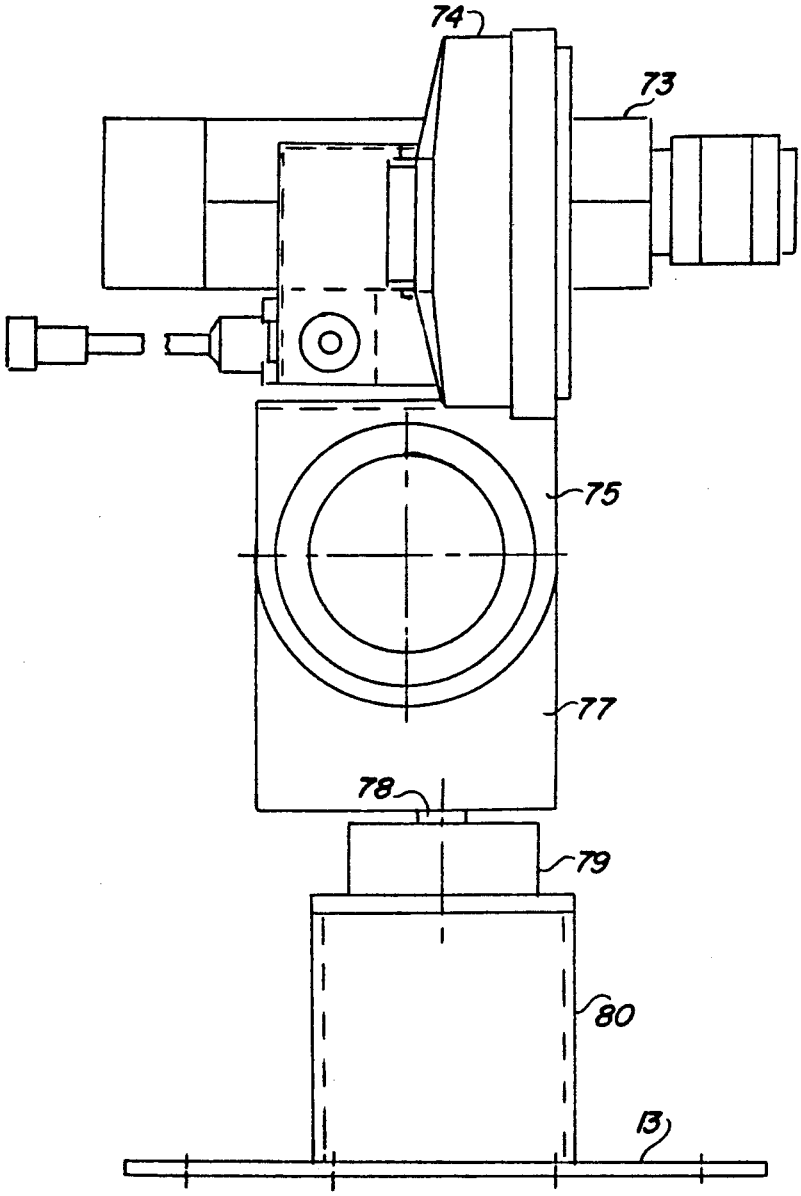
FIG. 6 is a side elevational view of the camera and lighting system support structure.

One of the arms 34 is illustrated in FIGS. 4 and 5, and as shown provides a hub 48 which provides the receiving socket 47 for the free end of the shaft 44. By this arrangement the arms 34 and 35 are movably connected to the vehicle 10.

The opposite free end of each of the arms 34 and 35, is provided with an end plate 49. The end plate is pivotally mounted by a suitable bearing 50 and knob screw 51 to the end of the arm. A second bearing 52 has limited pivotal movement through an arcuated slot 53 formed in the end plate 49 and adapted to be held in place by a knob screw 54. By this arrangement the end plate 49 may be angularly positioned relative to the end of the arm 34.

The end plate 49 is provided with an oblong center opening 55 which freely receives the free end of a shaft receiving hub 56. A spring plate 57 is placed in facial abutment upon the end plate 49 and over the center opening 55. The spring plate 57 provides two spaced apart screw posts 58 disposed to either side of the oblong center opening 55 which post are in alignment with like screw posts 59 carried by the end plate 49. A pair of expansion springs 60 are connected between the posts 58 and 59 so as to movably connect the spring plate 57 to the end plate 49. By suitable screw connectors 61 the spring plate 57 together with a spacer is attached to the inner end of the shaft receiving hub 56.

Figure 7:
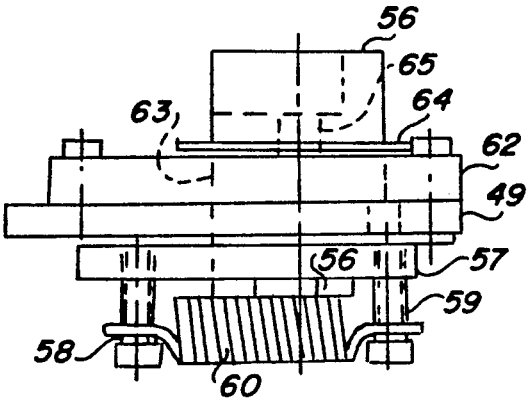
FIG. 7 is an end view of one of the supporting arms.

Mounted on the opposite side of the end plate 49 is a slider bearing 62 which is provided with a like center opening 63 which matches the center opening 55 in the end plate 49. By a retainer ring 64 the shaft receiving hub 56 is held in the openings 55 and 63 of the end plate 49 and slider bearing 62 respectively. As shown in FIG. 7 the shaft receiving hub 56 is provided with a center bore 65 which receives the shank 66 of a connecting pin 67. The pin 67 extends through aligned openings formed in the spring plate 57 and its spacer. A pull ring 68 is provided at the exposed end of the pin 67 so that it may be readily withdrawn from the assembly.

When a cleaning tool is mounted between the arms 34 and 35 its shaft's ends project into the shaft receiving hubs 56 with the pin 67 projected thereon. The tool is connected between the arms through its shaft's attachment by the pin 67 to the shaft receiving hub 56 thereby providing a quick connect/disconnect of the tools. A floating connection is established between the arm 34 and the tool through the expansion spring 60 which connect the spring plate 57 to the end plate 49. By this arrangement the spring-created floating connection permits optimum surface to tool relationship and thus optimum decontamination efficiency.

As shown in FIG. 1 the tool is adapted to be enclosed in a shroud 69 which by suitable end blocks 70 can be connected to the end plates 49. The shroud 69 provides quick connections for a vacuum hose 71 as well as a fluid conductor 72.

The self-propelled robotic decontamination apparatus of this invention is to be provided with a video camera 73, and on board lights 74 which are carried on a U-shaped mount 75, pivotally connected as at 76 to the side walls of a box-like compartment 77. The compartment 77 through a suitable rotatable post 78 projecting out of a bearing 79 is movably connected to a support cubicle 80 fixedly mounted on the top wall 13 of the vehicle 10. The camera 73 can be tilted through the pivotal connection 76 of its U-shaped mounting 75 and can be panned through the rotating of post 78. The mechanics for these operations are motorized gearing which make up no part of the present invention and which are well known in their respective arts.

Figure 9:
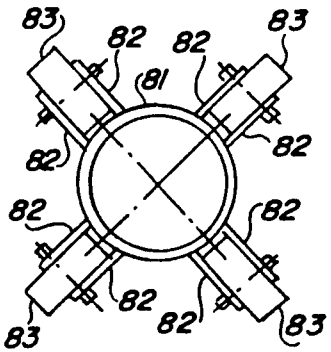
FIG. 9 is a front view of the cable and hose carriage employed in this invention.
Figure 8:
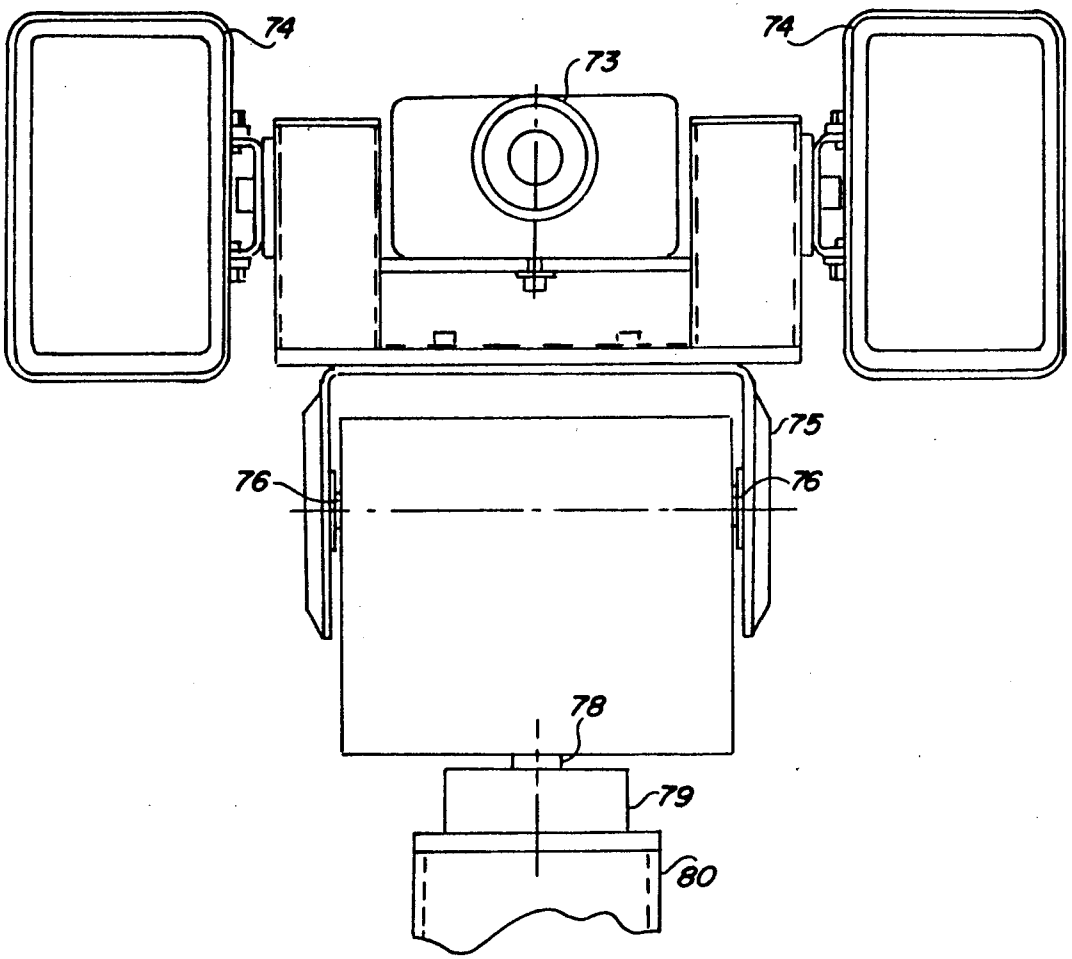
FIG. 8 is a frontal view of the camera and lighting system support.

The self-propelled remote vehicle 10 has umbilical hose and cable connections to a remote source of vacuum and cleaning fluid, as well as electrical power. In past like equipment these hose and cable connections simply laid on the surface to be cleaned and were dragged thereover by the cleaning apparatus. This action created hose and cable drag creating resistance to the maneuverability of the vehicle as well as creating a rolling over effect that twisted and restrained the movement of the hose or cable over the surface. The present invention provides a universal hose and cable carriage which consists of a ring 81 which embraces the hose or cable. This ring 81 as illustrated in FIG. 9, provides a series of radially extending equidistant pairs of flanges 82. Each pair of flanges 82 has rotatably mounted therebetween a roller 83. By this arrangement the hose or cable carrying ring 81 is supported away from the surface with a rolling contact being maintained between one or more of the rollers 83 with the supporting surface thus preventing cable and/or hose drag or roll over.

Mounted on the rear of the vehicle 10 is a electrical enclosure 84 which when connected to a suitable power source provides the operating power for the electric motors 20 and 22 and the tilting and panning of the camera 73.

From the foregoing there has been specifically described a remotely controlled vehicle, controlled from a portable control station. The vehicle utilizes low voltage DC drive systems for mobility and steering. Incorporated in the apparatus are detachable and interchangeable arm assemblies that allow the effective manipulating of cleaning attachments for the disposition of high temperature, high pressure cleaning fluids, coupled with high vacuum recovery to completely remove contaminates. Powered cleaning tools using the same principle of high pressure and temperature cleaning in addition to mechanical scrubbing action can be easily and effectively used with the remote vehicle tool handling assemblies.

In addition the apparatus may become an agile, powerful, remote surveillance vehicle by the readily removal of the tool supporting arms. The incorporation of remote close circuit television coupled with pan and tilt camera handling, on board lighting systems and the ability to maneuver over small obstacles in addition to optimally remote radiation monitoring, creates ideal surveillance capabilities.

While I have illustrated and described the preferred form of construction for carrying the invention into effect, this is capable of variation and modification without departing form the spirit of the invention. I therefore, do not wish to be limited to the precise details of construction as set forth, but desire to avail myself of such variations and modifications as come within the scope of the appended claims.

Having thus described my invention what I claim as new and novel and desire to protect by Letter patent is:

1. A self-propelled robotic decontaminating apparatus adapted to be coupled to a source of pressurized heated cleaning fluids and a filtered vacuum recovery system comprising:

a) a self-propelled vehicle, b) means for propelling and steering said vehicle over a surface to be treated, c) a surface treating element carried by and movable with said vehicle, d) a pair of removable arms mounted on said vehicle for attaching said element thereto, e) a rotatable shaft mounted on said vehicle removably connected to each of said arms so as to mount said arms onto said vehicle, f) a pair of pivot links fixedly mounted on said shaft, g) means carried by said vehicle and connected to said links so as to pivot said links and rotate said shaft about a fixed horizontal axis so as to provide limited vertical movement of said arms relative to said surface to be cleaned, h) means providing a limited floating connection between said arms and surface treating element, i) means for removably connecting said surface treating element to said means providing a limited floating connection, and j) a remote control for said means for propelling and steering said vehicle and said surface treating element over the surface to be treated.

2. A self-propelled robotic decontaminating apparatus as defined by claim 1 wherein said means for propelling and steering said vehicle over a surface to be treated comprises a pair of independently operated driving members including continuous vehicle moving tracks for each of said driving members for independently propelling and steering said vehicle.

3. A self-propelled robotic decontaminating apparatus as defined by claim 2 wherein said pair of independently operated driving members comprise low voltage electric motors.

4. A self-propelled robotic decontaminating apparatus as defined by claim 1 wherein said means for removably connecting said surface treating element to said means for providing a limited floating connection between said arms and said surface treating element comprising a removable pin adapted to be projected through said means providing a limited floating connection and into holding contact with said surface treating element.

5. A self-propelled robotic decontaminating apparatus as defined by claim 4 wherein said means for propelling and steering said vehicle over a surface to be treated comprises a pair of independently operated driving members including continuous vehicle moving tracks for each of said driving members for independently propelling and steering said vehicle.

6. A self-propelled robotic decontaminating apparatus as defined by claim 5 wherein said pair of independently operated driving members comprise low voltage electric motors.

7. A self-propelled robotic decontaminating apparatus as defined by claim 1 including a cable and hose umbilical between said vehicle and said remote control, and means for supporting said umbilical off the surface to be treated wile permitting free-movement in any direction.

8. A self-propelled robotic decontaminating apparatus as defined by claim 7 wherein said means for propelling and steering said vehicle over a surface to be treated comprises a pair of independently operated driving members including continuous vehicle moving tracks for each of said driving members for independently propelling and steering said vehicle.

9. A self-propelled robotic decontaminating apparatus as defined by claim 8 wherein said pair of independently operated driving members comprise low voltage electric motors.

10. A self-propelled robotic decontaminating apparatus as defined by claim 7 wherein said means for removably connecting said surface treating element to said means for providing a limited floating connection between said arms and said surface treating element comprising removable pin adapted to be projected through said means providing a limited floating connection and into holding contact with said surface treating element.

11. A self-propelled robotic decontaminating apparatus as defined by claim 1 including a remotely controlled camera mounted on said vehicle and having independent movement relative thereto.

12. A self-propelled robotic decontaminating apparatus as defined by claim 1 including illuminating means carried by said vehicle and having independent movement relative thereto.

13. A self-propelled robotic decontaminating apparatus as defined in claim 1 including a remotely controlled camera and illuminating means carried by said vehicle and having independent movement relative thereto.

* * * * *